US007064665B2

(12) United States Patent
Woodall et al.

(10) Patent No.: US 7,064,665 B2
(45) Date of Patent: Jun. 20, 2006

(54) PSEUDO—RANDOM STATE MECHANICAL SWITCH

(75) Inventors: Thomas R. Woodall, Valencia, CA (US); Milton K. Lum, Whittier, CA (US)

(73) Assignee: Raytheon Company, Waltham, MA (US)

( * ) Notice: Subject to any disclaimer, the term of this patent is extended or adjusted under 35 U.S.C. 154(b) by 202 days.

(21) Appl. No.: 10/890,545

(22) Filed: Jul. 13, 2004

(65) Prior Publication Data

US 2006/0012477 A1 Jan. 19, 2006

(51) Int. Cl.
*G08B 13/08* (2006.01)

(52) U.S. Cl. ..... 340/545.1; 340/545.2; 340/545.6; 340/5.61

(58) Field of Classification Search ..... 340/545.2
See application file for complete search history.

(56) References Cited

U.S. PATENT DOCUMENTS

| | | | | |
|---|---|---|---|---|
| 5,144,667 | A * | 9/1992 | Pogue et al. | 380/45 |
| 6,424,254 | B1 * | 7/2002 | Rydel | 340/426.16 |
| 6,696,918 | B1 * | 2/2004 | Kucharczyk et al. | 340/5.21 |
| 6,747,558 | B1 * | 6/2004 | Thorne et al. | 340/551 |
| 6,989,732 | B1 * | 1/2006 | Fisher | 340/3.1 |
| 2004/0263332 | A1 * | 12/2004 | Maple et al. | 340/545.1 |

* cited by examiner

*Primary Examiner*—Daniel Wu
*Assistant Examiner*—George A. Bugg
(74) *Attorney, Agent, or Firm*—Leonard A. Alkov; John E. Gunther; Karl A. Vick

(57) ABSTRACT

A method for detecting entry into a secure area uses a passive entry detector. The secure area has an access door, having a closed position. The passive entry detector comprises a source of energy internal or external to the passive entry detector, an activator for detecting a change in the access door from its closed position, and for releasing the energy in response to the change of the access door from the closed position. The energy is transferred to one or more pseudo random units. Each of the pseudo random units has a plurality of mechanical states. The pseudo random units are responsive to the activator. The activator induces a change of the mechanical states in the pseudo random units upon transfer of energy. The pseudo random units report the mechanical states upon interrogation. Using above passive entry detector, a first interrogation using the interface is performed to create a first record to identify one or more mechanical states with the access door in the closed position. Re-interrogating is performed again after an interval, typically prior to opening the access door from its closed position. This re-interrogating identifies again the mechanical states in the pseudo random units of the passive entry detector and generates a second record. Comparing the first record with the second record determines if the internal mechanical states have been altered during the time interval.

16 Claims, 3 Drawing Sheets

PSEUDO—RANDOM STATE MECHANICAL SWITCH

BACKGROUND OF THE INVENTION

This invention is in the field of access recording to an enclosure using mechanical switching units.

DESCRIPTION OF THE RELATED ART

One aspect of security for a secure area is to generate a robust record of access to the secure area. A record is critical to ascertain whether a secure area has been accessed after an initial set of conditions. The record is robust in that it is not alterable after entry and preserves a record of entry even in the face of attempted tapering or re-setting. Thus, the record becomes a credible, reliable source of access information, indicative of entry to the secure area.

Examples of the prior art include passive and active systems. Passive mechanisms require no power, that is the mechanism itself has a persistent residual characteristic that can be detected later for an indication of entry. Active systems, in contrast, require electrical power to both detect entry and record the information associated with the entry.

SUMMARY OF THE INVENTION

Above limitations are mitigated by a method for detecting entry into a secure area using a passive entry detector. The secure area has an access door, having a closed position for precluding entry to the secure area, and an open position for allowing entry to the secure area. The passive entry detector comprises:

a source of stored energy internal to the passive entry detector;

an activator for detecting a change in the access door from its closed position, the activator releasing the stored energy in response to the change of said access door from the closed position;

one or more pseudo random units, each of the (one or more) pseudo random units having a plurality of mechanical states, the pseudo random units responsive to the activator, the activator inducing a change of the mechanical states in (one or more) pseudo random units upon release of the stored energy;

an interface for encoding the mechanical states in the (one or more) pseudo random units and for reporting the mechanical states upon interrogation.

Using above passive entry detector, a first interrogation using the interface is performed to create a first record to identify one or more mechanical states in one or more pseudo random units with the access door in the closed position. The first record is typically secured in a location outside said secure area.

Re-interrogating is performed again after an interval, such as prior to opening the access door from its closed position. This re-interrogating identifies again one or more mechanical states in one or more pseudo random units of the passive entry detector and generates a second record. Comparing the first record with the second record determines if the internal mechanical states of the pseudo random units have been altered during the time interval by the access door having moved from its originally closed position.

The energy needed to change the mechanical states of the pseudo-random units can also be supplied by coupling said activator to said access door. As said access door is opened, the energy required to do so moves said activator, engaging one or more of said pseudo-random units, thus changing their internal states.

DETAILED DESCRIPTION OF THE INVENTION

The present invention describes an apparatus and method for robustly recording an entry into a secure area, said recording automatically triggered upon access into the secure area. The secure area can range from a building, ship or aircraft, to a small enclosure. The secure area typically contains critical equipment where access is controlled, that is, aiming to preclude unauthorized alteration or observation of contents within the secure area.

Unlike a typical key operated lock, the present invention does not aim to preclude access by presenting a physical barrier, or imposing the requirement of a key, or other access device prior to entry. Instead, the present invention creates a record of entry, that is, it records the movement, or one time displacement of a barrier to entry into a secure area, such as a door, locking dead bolt, hinge rotation, or any other change in position or shape of a security related structure. The occurrence of the one time displacement alters randomly mechanical states within the device so as generally preclude subsequent erasure, duplication or compromise of the record of entry.

Figure 1:
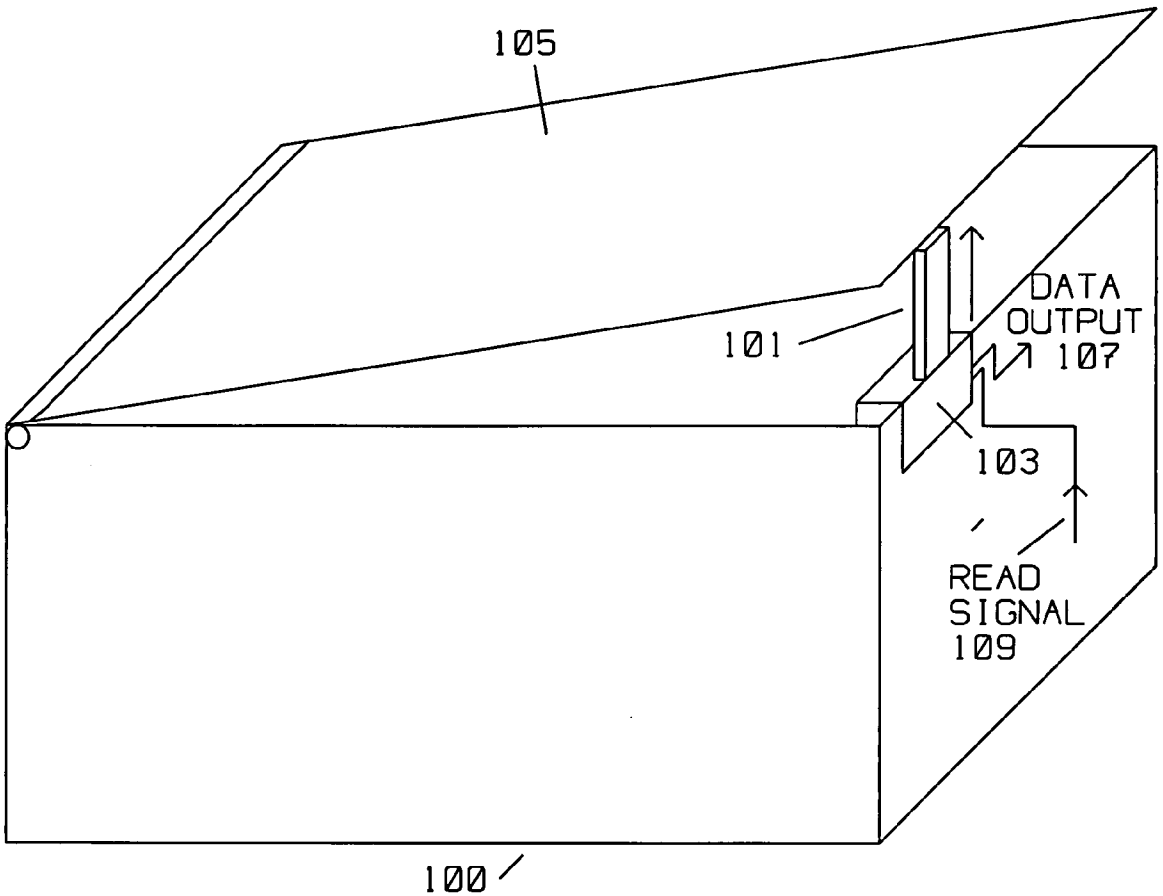
FIG. 1 is a sample configuration of the present invention showing a secure area using a passive entry detector.

Shown in FIG. 1 is an example of a passive entry detector 103 of the present invention monitoring the access status of an access door, 105 of a secure area 100. Cover 105 is typically closed, thus mating to secure area 100. When so secured, cover 105 keeps activator 101 from rising.

As the cover 105 is removed to gain access to secure area 100, entry detector 103 records mechanically the removal of the cover. The change in position of activator 101 alters a record indicative of the removal of cover 105. Entry detector 103 can be interrogated by read signal 109, internal mechanical states read out using data output 107. The state of data output 107, when compared to its initial state determines whether entry was gained into the secure area 100 during the time interval entry detector 103 was first set and the time of interrogation.

Figure 2:
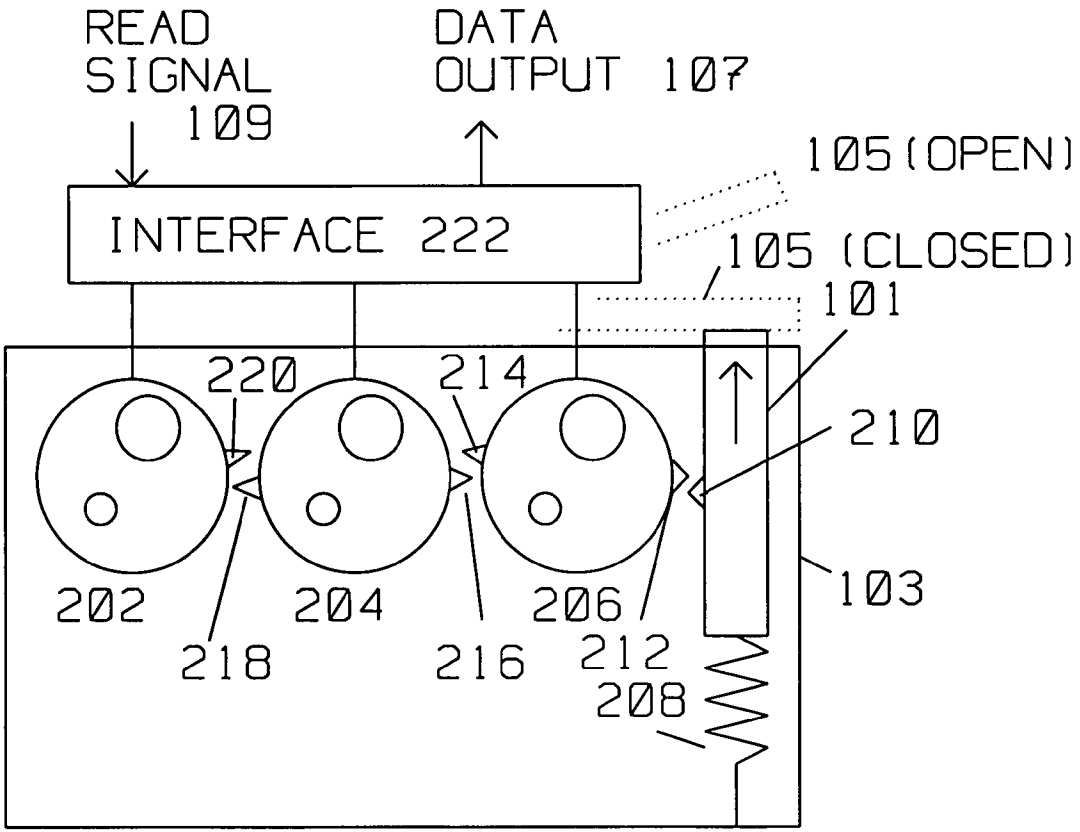
FIG. 2 is a sample configuration of the passive entry detector of the present invention.

FIG. 2 details an example of entry detector 103. Activator 101 is under pressure from spring 208, kept from moving upwards by cover 105 when access to enclosure 100 is not authorized. Once cover 105 is no longer in its closed position, compressed spring 208 forces activator 101 to move upwards. Activator 101, and tooth 210 engages cog 212 to rotate pseudo-random unit 206. Pseudo-random unit 206 has a plurality of mechanical states changed by the rotation of pseudo-random unit 206. The mechanical states of unit 206 are pseudo-random, that is, the mechanical states are not indicative of the position of cog 212 along the circumference of pseudo-random unit 206, but are a random sequence changing with every operation of unit 206 as well as its rotation. For example, when cog 212 is aligned horizontally, the code output by unit 206 is digital 1001. On a first engagement with tooth 210, for a rotation of 10 degrees, the output of unit 206 may change to 1101. On the next engagement, the same rotation of 10 degrees output may generate an output of 1011. There is only a pseudo random relationship between the first output 1101 and the second output 1011 and the position of cog 212 around the periphery of unit 206.

Examples of pseudo-random mechanical units generating a pseudo-random sequence of states for each revolution, such as the states generated by pseudo-random units 202, 204 and 206 are found in gambling (slot) machines where the push of a lever can initiate the generation of a plurality of pseudo random mechanical states from its internal pseudo-random mechanical units. Only when a pre-assigned set of pseudo-random states match a particular, pre-programmed sequence is a winner declared. Re-activating the pseudo-random units on the next cycle may or may not produce a win.

In turn, unit 206 uses tooth 214 to engage mechanically unit tooth 216 on unit 204, imparting rotation to unit 204. Like unit 206, unit 204 also changes mechanical states in response to it having been rotated. Tooth 218 on unit 204 in turn engages tooth 220 on unit 202, rotating unit 202. Unit 202 also changes state in response to it being rotated. Thus, the action of activator 101 has randomly changed data output 107 of entry detector 103. Manually re-positioning units 101, 204 and 206 to their initial position does not restore data output 107 to its initial state originally recorded at the pre-entry level.

The mechanical state of each unit 202, 204 and 206 is read out using interface 222. The read out of mechanical states 202, 204 and 206 is initiated by application of read signal 109. Read signal 109 may be as simple as the application of a logic 5V power. Once interface 222 is activated by logic 5 V power, interface 222 collects the mechanical states from mechanical units 202, 204 and 206 and forms a digital serial data stream indicative of the mechanical states of those units.

In another embodiment, interface 222 may output a parallel digital word indicative of the mechanical states of units 202, 204 and 206.

In yet another embodiment, the energy needed to rotate unit 206 or a similar pseudo random type switch is supplied by the motion of cover 105. That is, activator 101 is connected to cover 105. As cover 105 is separated from the enclosure to gain entry, its relative motion to the secure enclosure rotates unit 206.

Method

Figure 3:
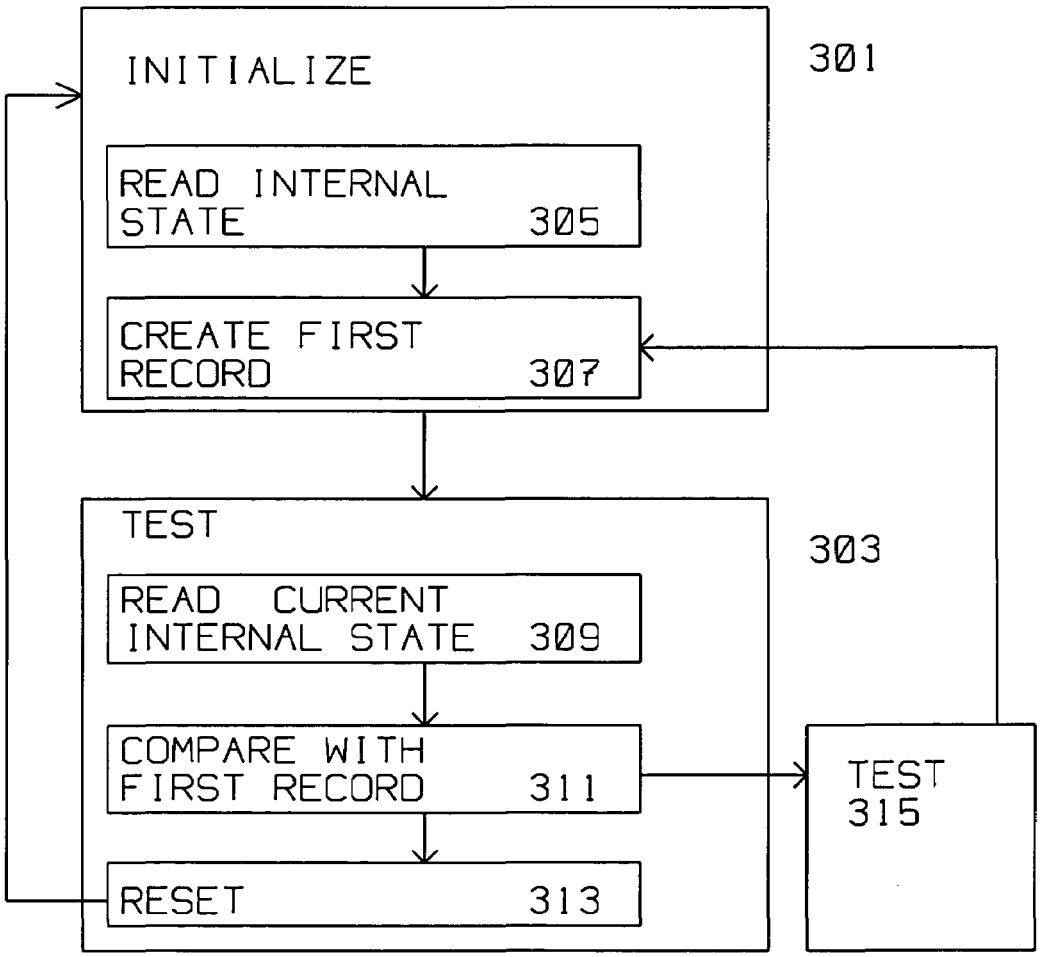
FIG. 3 is a flow diagram of the method for using said passive entry detector.

The method for detecting entry into a secure area using the passive entry detector of FIG. 2 is detailed in FIG. 3. Secure area 100 has an access door 105, the access door 105 having a closed position for precluding entry to said secure area, and an open position for allowing entry to secure area 100.

Interface 222 encodes the mechanical states in one or more pseudo random units such as 202, 204 and 206 and reports the mechanical states upon interrogation initiated with a signal read 109.

As shown in FIG. 3, initialization 301 performs a Read Initial State 305. This performs a first interrogation using signal read 109 of passive entry detector 103 with access door 105 closed. Using interface 222, the mechanical states in the pseudo random units with access door 105 in closed position are read out. The mechanical states are stored by create first record 307. This first record is secured in a location typically outside secure area 100, preferably remote from it.

Next, the mechanical states of pseudo random units 202, 204 and 206 are re-interrogated after an interval in read current internal state 309, typically prior to opening access door 105 from the closed position to obtain a second record. This second record can be obtained at any time a doubt exists as to whether door 105 may have been opened by unauthorized entities. The record is generated by activating read signal 109 and reading data output 107.

Compare with first record 311 compares the first record with the second record to determine if the mechanical states have been altered during the intervening time interval because access door 105 has moved from its originally closed position. This is part of security validate procedure 303. Test 315 is conducted at any time, and compares the first record create in create first record 307 to the current reading from the Pseudo Random state units. Thus, if a doubt exists as to entry into secure area 100, test 315 verifies the current status against the stored value, resolving said doubt.

For further security, access door 105 is now opened, and the internal states are reset in reset 313. The cycle can now be repeated.

Typically, each of said pseudo random units has 16 or more states for low value security risks. For higher value risks, up to 1024 internal mechanical states are envisioned. The energy stored in spring 208 is sufficient for changing the internal mechanical states within one or all of pseudo random units 202, 204 and 206. Energy storage is not limited to spring 208, but also compressed rubber, or any other elastomer having good flexibility.

All references cited in this document are incorporated herein in their entirety by reference.

Although presented in exemplary fashion employing specific embodiments, the disclosed structures are not intended to be so limited. For example, although pseudo random units 202, 204 and 206 are examples of mechanical switches, any other device capable of storing a plurality of distinct pseudo random states over a period of time without the need for external power can be used. For example, nano-technology units (switches) having similar characteristics are envisioned. Battery powered pseudo random units, where re-set time intervals are much shorter than battery life are also envisioned.

Those skilled in the art will also appreciate that numerous changes and modifications could be made to the embodiment described herein without departing in any way from the invention.

The invention claimed is:

1. A passive entry detector for recording an entry into a secure area, said secure area having an access door, said access door having a closed position for precluding entry to said secure area, said passive entry detector comprising:

an activator for detecting a change in said access door from said closed position, said activator transferring energy in response to said change in position of said access door from said closed position;

one or more pseudo random units, each of said one or more pseudo random units having a plurality of mechanical states, said pseudo random units responsive to said activator, said activator inducing a change of said mechanical states in said one or more pseudo random units upon transfer of said energy from said activator;

an interface for encoding said mechanical states in an electronically compatible format and for reporting said mechanical states upon interrogation.

2. A passive entry detector as described in claim 1 wherein each of said pseudo random units has 16 or more states, said energy sufficient for changing said states within said one or more pseudo random units.

3. A passive entry detector as described in claim 1 wherein said energy is stored in a spring.

4. A passive entry detector as described in claim 1 wherein said energy is stored in a compressed rubber.

5. A passive entry detector as described in claim 1 wherein said activator is coupled to said access door and said energy is supplied by opening said access door.

6. A passive entry detector as described in claim 1 wherein said interrogation is initiated by an electric read signal.

7. A passive entry detector as described in claim 6 wherein said interrogation initiated by said electric read signal reports said one or more mechanical states using a digital serial stream in response to said interrogation.

8. A passive entry detector as described in claim 6 wherein said interrogation initiated by said electric read signal reports said one or more mechanical states using a digital parallel stream in response to said interrogation.

9. A method for detecting entry into a secure area using a passive entry detector, said secure area having an access door, said access door having a closed position for precluding entry to said secure area, said passive entry detector comprising:

an activator for detecting a change in said access door from said closed position, said activator transferring energy in response to said change in position of said access door from said closed position;

one or more pseudo random units, each of said one or more pseudo random units having a plurality of mechanical states, said pseudo random units responsive to said activator, said activator inducing a change of said mechanical states in said one or more pseudo random units upon transfer of said energy from said activator;

an interface for encoding said mechanical states in said one or more pseudo random units and for reporting said mechanical states upon interrogation, said method comprising the steps of:

first interrogating said passive entry detector using said interface to identify one or more mechanical states in said one or more pseudo random units with said access door in said closed position to create a first record;

re-interrogating after an interval said passive entry detector prior to opening said access door from said closed position to identify one or more mechanical states in said one or more pseudo random units while said access door is in said closed position to obtain a second record;

comparing said first record with said second record to determine if said mechanical states have been altered during said interval by said access door having moved from said closed position.

10. A method as described in claim 9 wherein each of said pseudo random units has 16 or more states, said energy sufficient for changing said states within said one or more pseudo random units.

11. A method as described in claim 9 wherein said energy is stored in a spring.

12. A method as described in claim 9 wherein said energy is stored in a compressed rubber.

13. A passive entry detector as described in claim 9 wherein said activator is coupled to said access door and said energy is supplied by opening said access door.

14. A method as described in claim 9 wherein said interrogation is initiated by an electric read signal.

15. A method as claimed in claim 14 wherein said one or more mechanical states are reported using a digital serial stream in response to said interrogation.

16. A method as claimed in claim 14 wherein said one or more mechanical states are reported using a digital parallel stream in response to said interrogation.

* * * * *